US005455656A

United States Patent [19]

Covert et al.

[11] Patent Number: 5,455,656

[45] Date of Patent: Oct. 3, 1995

[54] AUTOMATIC VARIABLE PITCH RECONFIGURATION CONTROL IN AN ELECTROSTATOGRAPHIC PRINTING MACHINE

[75] Inventors: David W. Covert, Ontario; José A. Peña, Rochester, both of N.Y.

[73] Assignee: Xerox Corporation, Stamford, Conn.

[21] Appl. No.: 327,958

[22] Filed: Oct. 24, 1994

[51] Int. Cl.[6] ..... G03G 21/00

[52] U.S. Cl. ..... 355/207; 355/208; 355/212; 198/301

[58] Field of Search ..... 355/207, 208, 355/212, 326 R, 327; 198/301; 364/565

[56] References Cited

U.S. PATENT DOCUMENTS 4,416,534 11/1983 Kluger .
4,541,709 9/1985 Kampschreur .
4,588,284 5/1986 Federica et al. .
5,101,232 3/1992 Evans et al. ..... 355/208
5,204,620 4/1993 Costanza et al. ..... 250/571 X
5,233,402 8/1993 Yagi et al. ..... 355/327 X
5,237,521 8/1993 Raj et al. ..... 364/561
5,258,775 11/1993 Casey et al. ..... 346/108 X
5,313,254 5/1994 Temple ..... 355/208
5,381,167 1/1995 Fujii et al. ..... 355/326 R
5,383,014 1/1995 Nowaki et al. ..... 355/308 X

*Primary Examiner*—R. L. Moses
*Attorney, Agent, or Firm*—Denis A. Robitaille

[57] ABSTRACT

An apparatus and associated method for controlling the operating speed of a photoreceptor within an electrostatographic printing machine having a belt type photoreceptive member for recording a plurality of latent images thereon. The process provides automatic reconfiguration of the electrostatographic printing machine control system to determine appropriate pitch timing values in response to a measurement of the actual belt speed as measured by the elapsed time for a single rotation of the photoreceptor belt.

12 Claims, 4 Drawing Sheets

AUTOMATIC VARIABLE PITCH RECONFIGURATION CONTROL IN AN ELECTROSTATOGRAPHIC PRINTING MACHINE

The present invention relates generally to an electrophotographic printing machine, and more specifically concerns a process for providing automatic adjustment and variable pitch reconfiguration control in response to variations in photoreceptor belt speed in an electrophotographic printing machine.

In a typical electrophotographic copying process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy substrate such as a sheet of paper. Thereafter, heat or some other treatment is applied to the toner particles to permanently affix the powder image to the copy substrate. In a final step in the process, the photoreceptive member is cleaned to remove any residual developing material on the photoconductive surface thereof in preparation for successive imaging cycles.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

In high speed electrophotographic printing machines of the type described hereinabove, successive electrostatic latent images are typically recorded closely adjacent to one another on a photoconductive belt, each latent image being separated by a so-called interdocument zone. Thus, the photoreceptive belt is typically divided into a series of "pitches", wherein each pitch represents an individual image travelling through various states during the electrophotographic reproduction process. More than one image area or pitch may be defined on the photoreceptive belt at any one time.

Timing and synchronizing of various events related to various pitches is essential for the control of the electrostatographic reproduction process. Thus, it is necessary to precisely track the time that a particular event should occur with respect to a particular pitch. Such control is typically effected by a series of precisely timed clock signals relating to each pitch for synchronizing and coordinating the various events which occur during the electrophotographic reproduction process. Thus, in a typical electrostatographic copying machine, wherein various processing stations are employed for providing such functions as uniform charging, exposure, development, transfer, cleaning and fusing during any given image processing cycle, it becomes very important to provide a proper base for timing the sequence of operations of the various processing stations in order to maintain proper timing the processing functions relative to the images being generated. For example, it should be evident that it is necessary to provide efficient and reliable movement of sheets of copy paper along a paper path for precisely timed delivery of the copy paper to the transfer station with respect to the transport of a developed electrostatic image for providing proper control of the machine operation.

It is well known to provide a control system having means for providing a series of clock pulses in a data stream, means for generating a reset signal or a series of successive start pulses for each processing cycle, and means for generating a plurality of timed control signals derived from the start and clock pulses in order to enable the various processing stations to implement the machine processing steps in a precisely timed manner. As a particular example, commonly assigned U.S. Pat. No. 3,917,396 discloses a control system utilizing start or reset pulses keyed to the displacement or position of the photoreceptor belt which is monitored by a speed responsive element. That patent also teaches a system adapted to generate more than one cycle of enabling pulses for processing more than one copy at any given moment.

Generally, the number of pitches per belt cycle in a specific machine configuration is a fixed number such that the adaptability of the machine and the control system thereof is limited to that specific machine configuration and is not adaptable to other machine configurations. However, it would be desirable to provide a capability to control tasks for a given number of pitches and machine clocks within a pitch while providing the further capability to control tasks based on the number of pitches in a cycle and the machine clocks within the pitch when the number of pitches within the machine has changed.

Various techniques are known for enabling photoreceptor belt speed control in an electrostatographic printing apparatus. The prior art, however, does not disclose an automatic variable pitch reconfiguration control system adaptable to different machine configurations and different belt and motor speeds.

The following disclosures may be relevant to various aspects of the present invention:

U.S. Pat. No. 4,416,534
Patentee: Kluger
Issued: Nov. 22, 1983
U.S. Pat. No. 4,588,284
Patentee: Federico, et al.
Issued: May 13, 1986
U.S. Pat. No. 5,101,232
Patentee: Evans, et al.
Issued: Mar. 31, 1992

The relevant portions of the foregoing disclosures may be briefly summarized as follows:

U.S. Pat. No. 4,416,534 discloses an apparatus and method for registering copy sheets in a variable pitch reproduction machine, wherein the speed and position of both a developed image on a photoreceptor belt and a copy sheet are monitored and updated by a programmed microprocessor. Controlled accelerations and decelerations of a copy sheet drive motor under the microprocessor control provides initial registration and then maintains registration throughout the image transfer process. In that patent, the registration provided by the microprocessor control automatically adjusts for variable spacings between successive images about the periphery of the photoconductor for accommodating various image sizes.

U.S. Pat. No. 4,588,284 discloses a control system for automatically altering the control of the machine to respond to a different number of pitches or images which the machine can manage at a particular time. Machine control is adjusted in accordance with a memory flag to manage a different number of pitches during the operation of the machine and to provide clock signals for the timed actuation of events in each of the pitches.

U.S. Pat. No. 5,101,232 discloses an apparatus and associated method for controlling the velocity of a photoreceptor within a reprographic machine having a seamed, web type photoreceptor, for producing a plurality of images thereon, wherein the images are separated by unexposed interdocument regions on the photoreceptor belt. That patent is particularly concerned with a process for assuring that the seamed region of the photoreceptor belt lies within an interdocument region, whereby a phase error value is calculated by comparing the actual phase relationship of the photoreceptor seam to a desired phase relationship in order to determine an adjustment photoreceptor velocity as a function of the phase error. The photoreceptor is moved at a fixed velocity during exposure of images and photoreceptor velocity adjustments are restricted to periods when the interdocument zone passes through the imaging station, thereby insuring that registration requirements and image quality specifications are simultaneously accomplished.

It is desirable to provide a method, as well as an electrostatographic copying system adapted to include an apparatus, for controlling the operating speed of a photoreceptor within an electrostatographic printing machine having a belt type photoreceptive member for recording a plurality of latent images thereon. The process provides automatic reconfiguration of the electrostatographic printing machine control system to determine appropriate pitch timing values in response to a measurement of the actual belt speed as measured by the elapsed time for a single revolution of the photoreceptor belt.

In accordance with the present invention, there is provided a method for automatically initiating a machine reconfiguration in an electrostatographic printing machine including a photoreceptor belt, to synchronize the activation of various machine subsystems in response to a variation in actual photoreceptor belt speed, comprising the steps of: measuring actual photoreceptor belt speed for a selected revolution of the photoreceptor belt; calculating an average photoreceptor belt speed for a plurality of selected revolutions of the photoreceptor belt; comparing the actual photoreceptor belt speed to the average photoreceptor belt speed, for determining whether the actual photoreceptor belt speed is within a predetermined range relative to the average photoreceptor belt speed; and initiating a machine configuration in response to a determination that the actual photoreceptor belt speed is outside the predetermined range relative to the average photoreceptor belt speed. The machine reconfiguration step includes synchronizing the activation of various machine subsystems in accordance with the average photoreceptor belt speed.

Pursuant to another aspect of the present invention, there is provided an electrophotographic printing apparatus having a photoreceptor belt wherein a system for automatically initiating a machine reconfiguration to synchronize the activation of various machine subsystems in response to a variation in actual photoreceptor belt speed is provided comprising: means for measuring actual photoreceptor belt speed for a selected revolution of the photoreceptor belt; means for calculating an average photoreceptor belt speed for a plurality of selected revolutions of the photoreceptor belt; means for comparing the actual photoreceptor belt speed to the average photoreceptor belt speed, for determining whether the actual photoreceptor belt speed is within a predetermined range relative to the average photoreceptor belt speed; and means for initiating a machine reconfiguration in response to a determination that the actual photoreceptor belt speed is outside the predetermined range relative to the average photoreceptor belt speed. The means for initiating machine reconfiguration includes means for synchronizing activation of various machine subsystems in accordance with the average photoreceptor belt speed.

Other aspects of the present invention will become apparent as the following description proceeds and upon reference to the drawings, in which.

Figure 1:
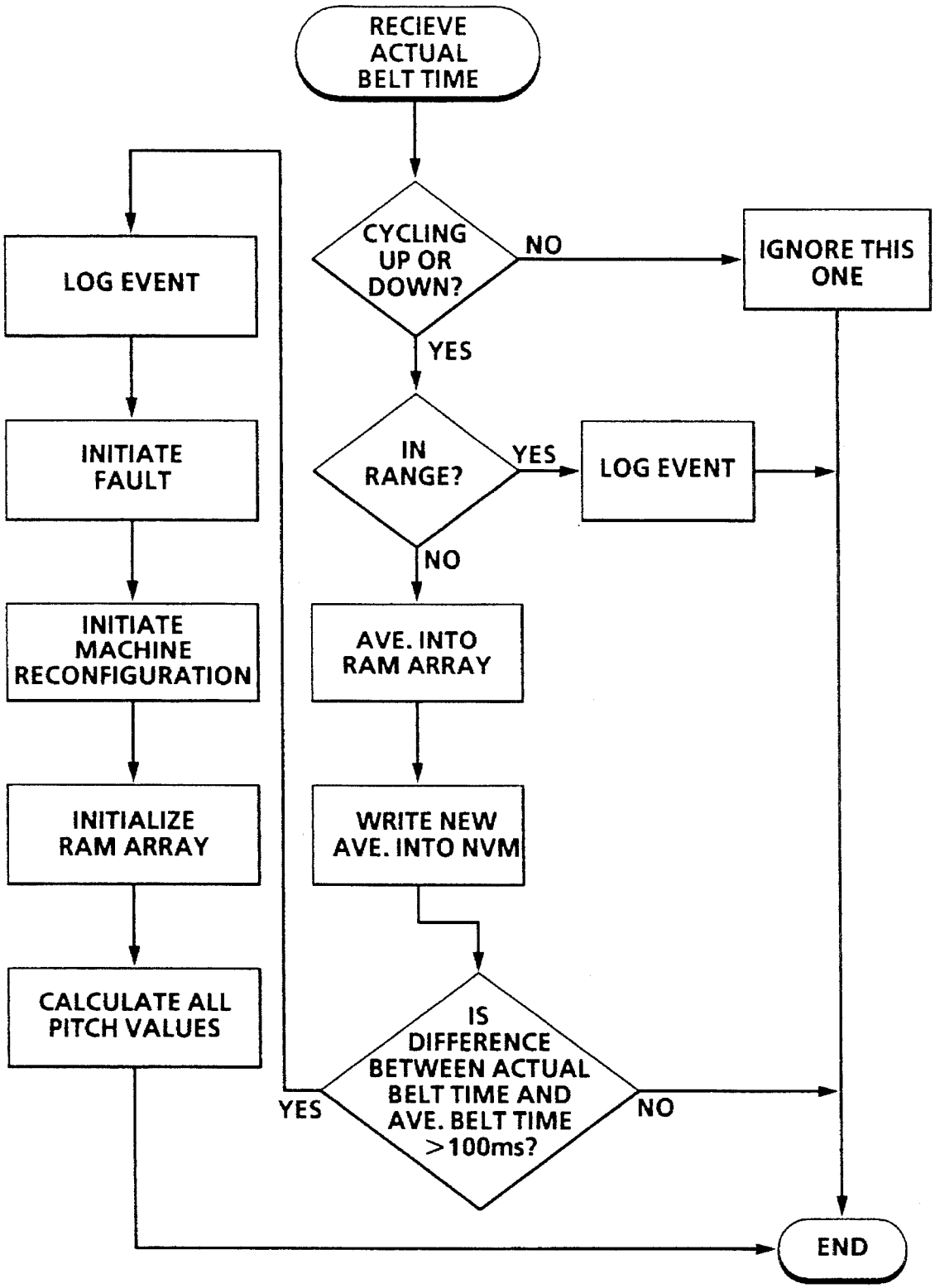
FIGS. 1 and 2 show flow charts of a control algorithm for providing the automatic variable pitch reconfiguration control functions of the present invention.

While the present invention will hereinafter be described in connection with a preferred embodiment and process, it will be understood that it is not intended to limit the invention to that embodiment or process. On the contrary, the following description is intended to cover all alternatives, modifications, and equivalents, as may be included within the spirit and scope of the invention as defined by the appended claims. Other aspects and features of the present invention will become apparent as the following description progresses.

For a general understanding of the features of the present invention, reference is made to the drawings, wherein like reference numerals have been used to identify particular elements, components and subsystems. Inasmuch as the art of electrostatographic reproduction is well known, the various processing stations employed in such reproduction machines will initially be described briefly with reference to FIG. 34. It will become apparent from the following discussion that the control system of the present invention is equally well suited for use in a wide variety of electrophotographic or other electronic printing systems. It will be further understood that the present invention is not necessarily limited in its application to the particular embodiment or embodiments shown and described herein.

Figure 4:
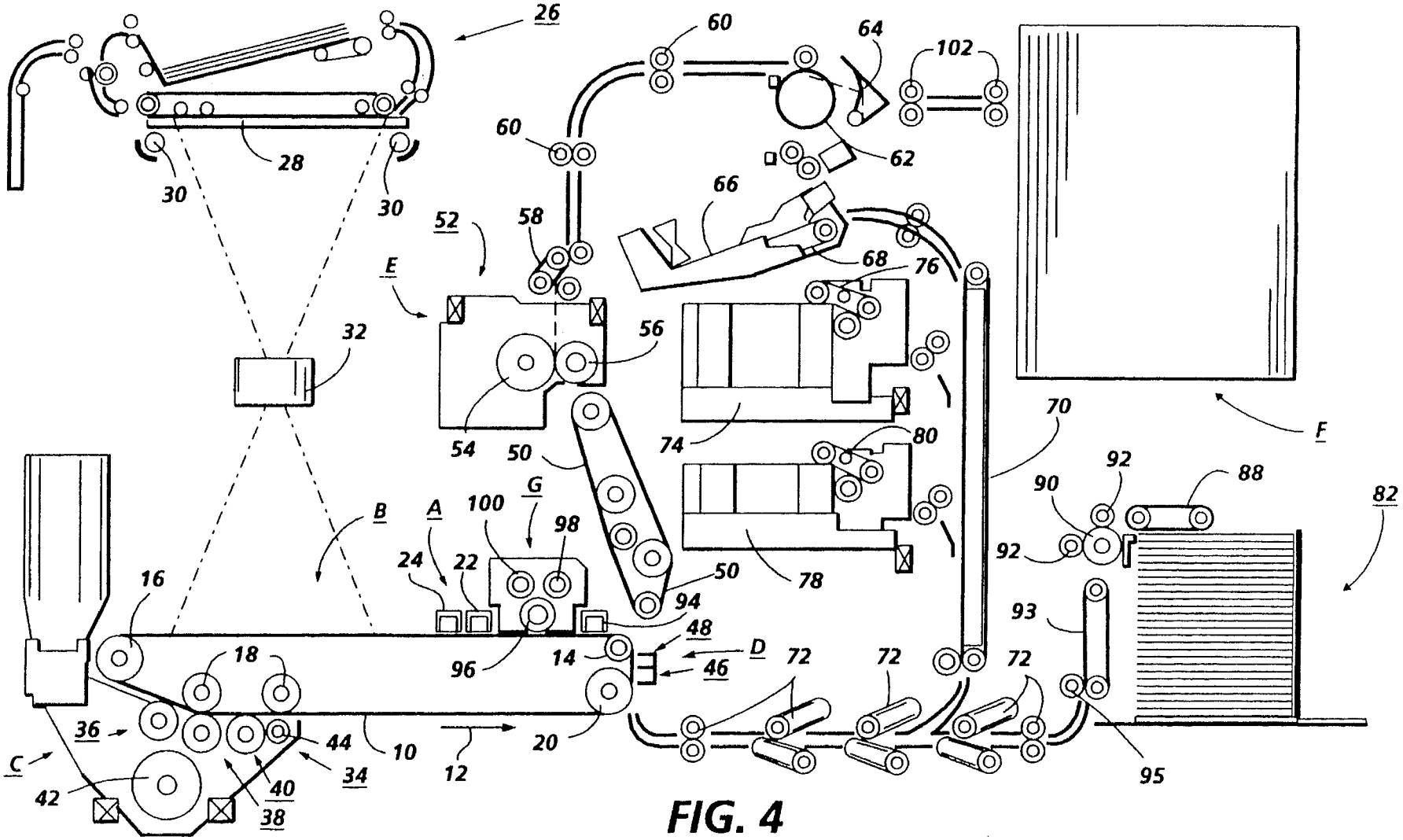
FIG. 4 is a schematic elevational view depicting an illustrative electrophotographic printing machine of the type which could advantageously utilize the automatic variable pitch reconfiguration control provided by the present invention.

Turning initially to FIG. 4, prior to discussing the invention in detail, a schematic depiction of an exemplary electrophotographic reproducing machine incorporating various subsystems is furnished wherein a photoconductive belt 10 is employed, preferably comprising a photoconductive material coated on a ground layer, which, in turn, is coated on an anti-curl substrate. The photoconductive material typically includes a transport layer, which may contain molecules of di-m-tolydiphenylbiphenyldiamine dispersed in a polycarbonate, coated on a generator layer, generally made from trigonal selenium. The grounding layer is typically made from a titanium coated Mylar. Of course, other suitable photoconductive materials, ground layers, and anti-curl substrates may also be employed.

Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under a desired tension. Drive roller 20 is rotated by a motor (not shown) coupled thereto by any suitable means such as a drive belt. Thus, the rotational movement of roller 20 advances belt 10 in the direction of arrow 12 to advance successive portions of the photoconductive surface sequentially through the various processing stations disposed about the path of movement thereof.

Initially, a portion of photoconductive belt 10 passes through charging station A whereat two corona generating devices, indicated generally by reference numerals 22 and 24, charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas which may have been missed by corona generating device 22.

Next, the charged portion of photoconductive belt 10 is advanced through imaging station B, whereat an original document to be reproduced is placed on platen 28 for being imaged onto the charged photoconductive belt 10. Imaging of the document is achieved by two flash lamps 30 mounted in the optics cavity for illuminating the document on platen 28. Light rays reflected from the document are transmitted through lens 32 which focuses the light image of the original document onto the charged portion of the photoconductive surface of belt 10 to selectively dissipate the charge thereon. This records an electrostatic latent image on photoconductive belt 10 corresponding to the informational areas contained within the original document. Thereafter, photoconductive belt 10 advances the electrostatic latent image recorded thereon to development station C.

It is noted that, at imaging station B, a document handling unit, indicated generally by reference numeral 26, may be positioned over platen 28 of the printing machine. The document handling unit 26 sequentially feeds documents from a stack of documents placed in a document stacking and holding tray such that the original documents to be copied are loaded face up into the document tray on top of the document handling unit. Using this system, a document feeder, located below the tray, feeds the bottom document in the stack to a pair of rollers for advancing the document onto platen 28 by means of a belt transport which is lowered onto the platen with the original document being interposed between the platen and the belt transport. When the original document is properly positioned on platen 28, the document is imaged and the original document is returned to the document tray from platen 28 by either of two paths. If a simplex copy is being made or if this is the first pass of a duplex copy, the original document is returned to the document tray via a simplex path. Conversely, if this is the inversion pass of a duplex copy, then the original document is returned to the document tray through a duplex path.

At development station C, a magnetic brush developer housing, indicated generally by the reference numeral 34, is provided, having three developer rolls, indicated generally by the reference numerals 36, 38 and 40. A paddle wheel 42 picks up developer material, generally comprising triboelectrically charged carrier granules and toner particles, in the developer housing 34 for delivering the developer material to the developer rolls. When the developer material reaches rolls 36 and 38, it is magnetically split between the rolls with approximately half of the developer material being delivered to each roll. Photoconductive belt 10 is situated adjacent rolls 36 and 38 for attracting toner particles from an extended development zone formed thereby. Developer roll 40 is a cleanup roll and magnetic roll 44 is a carrier granule removal device adapted to remove any carrier granules adhering to belt 10. Thus, rolls 36 and 38 advance developer material into contact with the electrostatic latent image, whereby the latent image attracts toner particles from the carrier granules of the developer material to form a toner powder image on the photoconductive surface of belt 10.

After development, belt 10 then advances the toner powder image to transfer station D, where a sheet of support material or copy sheet (not shown) is moved into contact with the toner powder image. As can be seen in the illustrated embodiment, a corona generating device 46 charges the copy sheet to a proper potential so that the sheet is electrostatically secured or "tacked" to belt 10. Corona generating device 46 also provides electostatic fields for attracting the toner image from the photoreceptor belt 10 to the copy sheet. Thus, the transfer station operates to induce contact between the developed image on belt 10 and the sheet of support material for transfer of the toner image thereon.

A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D.

After the developed image is transferred to the copy sheet, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, for permanently affixing the transferred toner powder image to the copy sheet. Preferably, fuser assembly 52 includes a heated fuser roller 54 and a pressure roller 56. The developed copy sheet is transported to the fusing station with the powder image on the copy sheet contacting fuser roller 54. The pressure roller 56 abuts the fuser roller 54 to provide the necessary pressure to fix the toner powder image to the copy sheet. In this exemplary fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl as well as any other curls or wrinkles which may have been introduced into the copy sheet. The copy sheet is then advanced, via forwarding roller pairs 60 to duplex turn roll 62. A duplex solenoid gate 64 selectively guides the copy sheet to finishing station F or to duplex tray 66. In the finishing station, the copy sheets are collected in sets and the copy sheets of each set can be stapled or glued together. Alternatively, a solenoid activated gate 64 can be used to divert the sheet into duplex tray 66, providing intermediate storage for those sheets that have been printed on one side and on which an image will be subsequently printed on the second, opposed side thereof, i.e. the sheets being duplexed. Duplex sheets are typically stacked in duplex tray 66 face down in a configuration, one on top of another, in the order in which they are copied. In order to complete duplex copying, the simplex sheets in tray 66 are fed, in seriatim, by a bottom feeder 68, from tray 66 back to transfer station D, via conveyor 70 and rollers 72. These sheets are then transported back to the transfer station for transfer of a toner powder image to the opposite sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets may also be fed to transfer station D from a secondary tray 74 or an auxiliary tray. 78 for providing additional sheet capacity on special types of copy sheets. Each tray includes an elevator driven by a bidirectional AC motor and a controller having the ability to drive the tray up or down. When the tray is in the down position, stacks of copy sheets are loaded thereon or unloaded therefrom. In the up position, successive copy sheets may be dispersed therefrom by a sheet feeder 76. Sheet feeder 76 may comprise a friction retard feeder, as shown schematically in FIG. 3, utilizing a feed belt and take-away rolls to advance successive copy sheets to transport 70 which, in turn, advances the sheets to rolls 72 and then to transfer station D. It will be recognized that secondary tray 74 and auxiliary tray 78 are supplemental sources of copy sheets for providing machine adaptability and flexibility for particular print jobs.

Invariably, after the copy sheet is separated from photoconductive belt 10, some residual particles remain bonded thereto. Thus, after transfer, photoconductive belt 10 passes beneath yet another corona generating device 94 which charges the residual toner particles to the proper polarity for breaking the bond between the toner particles and the belt. Thereafter, a precharge erase lamp (not shown), located inside the loop formed by photoconductive belt 10, discharges the photoconductive belt in preparation for the next charging cycle. Residual particles are removed from the photoconductive surface at cleaning station G which may include an electrically biased cleaner brush 96 and two waste and reclaim de-toning rolls 98 and 100, as illustrated. The reclaim roll 98 may be electrically biased to a polarity opposite that of the cleaner roll 96 so as to remove toner particles therefrom while the waste roll 100 may also be electrically biased positively relative to the reclaim roll 98 so as to remove paper debris and wrong sign toner particles. The toner particles on the reclaim roll 98 are scraped off and deposited in a reclaim auger (not shown), where they are transported out of the rear of cleaning station G.

The various machine functions are regulated by a controller (not shown) which is preferably a programmable microprocessor which manages all of the machine functions hereinbefore described. The printer controller controls all the printer steps and functions as described herein, including imaging onto the photoreceptor, paper delivery, xerographic functions associated with developing and transferring the developed image onto the paper, and various processing functions provided by finishing station F. The printer controller initiates a sequencing schedule which is highly efficient in monitoring the status of a series of successive print jobs which are to be printed and finished in a consecutive fashion. Conventional sheet path sensors or switches may be utilized to keep track of the position of documents and the sheets in the machine. In addition, the controller regulates the various positions of gates and switching mechanisms, depending upon the mode of operation selected. Among other things, the controller may provide time delays, jam indications and fault actuation. The operation of all of the exemplary systems described hereinabove may be accomplished by a conventional user interface control having the capability to provide operator input through a console or graphic user interface device.

The foregoing description should be sufficient for the purposes of the present disclosure for patent to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Figure 3:
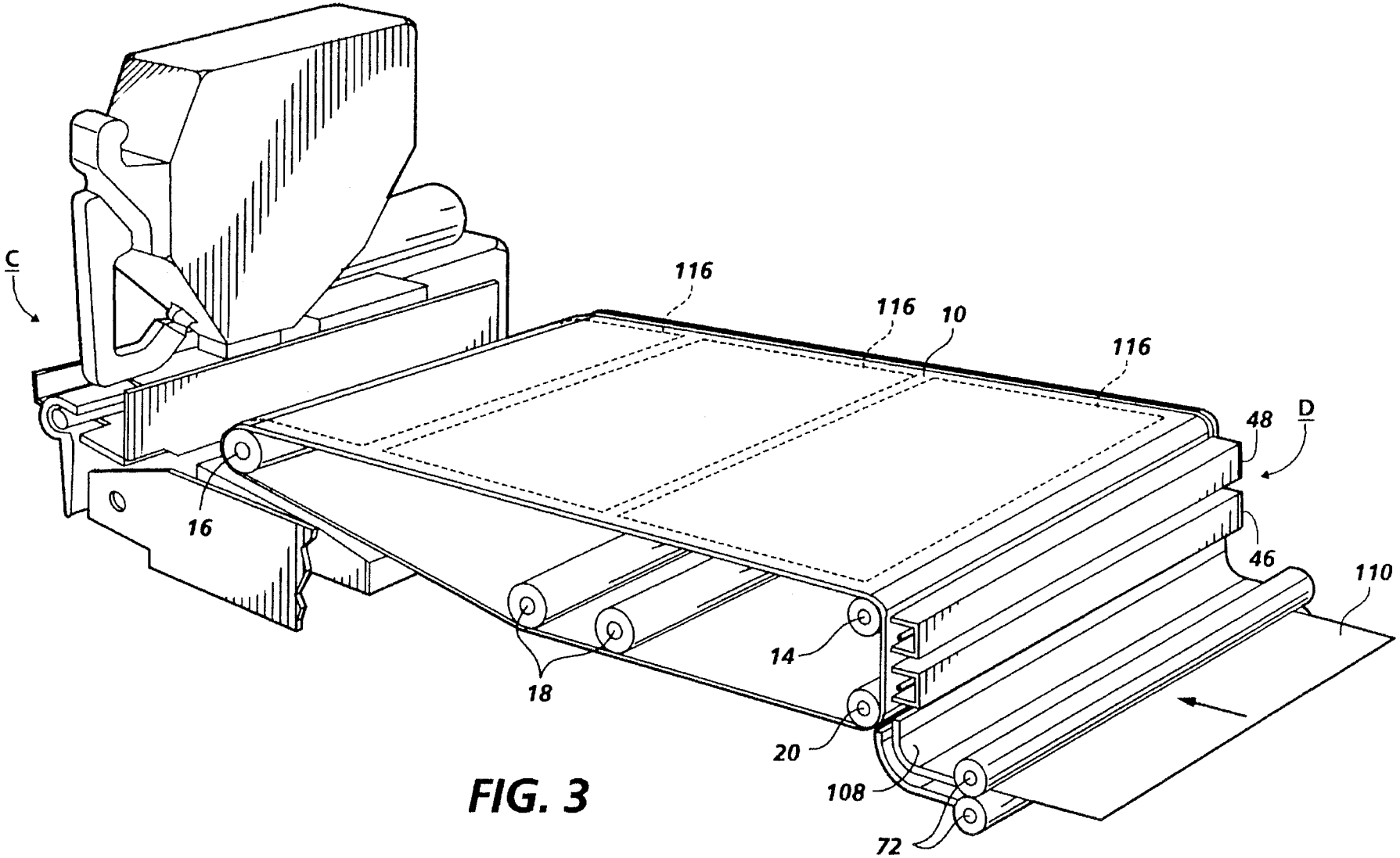
FIG. 3 is a perspective view of an illustrative photoreceptor belt showing a plurality of image areas or "pitches" superimposed thereon.

Referring now to FIG. 3, wherein further details of the photoreceptor and sheet transfer apparatus are shown, a copy sheet, identified by reference numeral 110 is shown entering the input side of the transfer station D, comprising transfer corotron 46 and detack corotron 48 situated in a spaced relationship to photoreceptor belt 10. The copy sheet 110 is engaged by a feed nip comprising a pair of rollers 72 operative to transport the copy sheet 110 to the transfer station through chute 108. The copy sheet is subsequently advanced into contact with photoreceptor belt 10, where it will meet the belt 10 in synchronization with a developed latent image area thereon.

A plurality of latent image areas, or so-called pitches 116, are shown in phantom on the surface of the photoreceptor belt 10. It will be understood that the number of pitches 116 fitting on the photoreceptor belt 10 is a function of the dimension of the photoreceptor belt 10 as well as the size of each pitch thereon. In many commercial copiers, the number of pitches occupied by images about the photoconductor belt 10 is a fixed quantity. That is, so long as each output document has substantially the same width, the pitch or latent image area spacing will remain constant. In such a fixed pitch system, the task of timing and synchronizing the various events related to various image areas is relatively simple so long as the photoreceptor belt 10 is driven and maintained at a constant rate. Thus, for example, assuming that the developed images on the photoreceptor belt 10 approach the transfer station D at a constant rate, the task of registering the copy sheet with the developed powder image is reduced to insuring that the copy sheets are driven to the transfer station at the same rate once an initial synchronization is achieved between the sheet and the image. In theory, since the spacing between individual copy sheets is chosen to be equal to a fixed and constant photoconductor pitch value, only minor changes in the copy sheet drive speed are needed to maintain registration.

It is well known that a fixed pitch system as described above, has very limited application in the high speed copying and printing business. It is advantageous to provide a copier with a multiple or variable pitch systems, wherein output copy sheets of various widths can be produced such that image spacing about the periphery of the photoreceptor belt 10 can vary with respect to output document size as well as input document size. For example, a photoreceptive belt may accommodate as many as eight images for a first size document while being capable of accommodating as few as three images for a much wider document. Of course, such variable pitch copier systems would be expected to accommodate a continuum of pitches between a minimum and maximum number. In addition to system flexibility advantages, it is noted that photoreceptor belt speed often varies significantly due to wear in system components, belt stretching, clutch slippage, power supply variation, and time delays in registration signal transmission, among other factors. Thus, it is also advantageous to provide a variable pitch system wherein the number of pitches laid down on the belt can be varied in response to the variable speed of the belt.

However, changes in pitch values result in concomitant changes in timing and synchronization of various events within the electrostatographic reproduction machine. In addition, variations in the quantity of pitches on a photoreceptor belt may also affect the way in which the document is imaged on to the photoreceptor. Variations in pitch quantities on the photoreceptor belt requires that the timing of the activation of machine subsystems related to the variable pitches must also be varied. This resynchronization process is commonly referred to as machine reconfiguration which generally involves a modification to the scheduling software in the machine controller, described hereinabove. Thus, providing variable pitch capability requires machine reconfiguration capability, wherein numerous system status inputs are continually monitored and varied in accordance with the actual photoreceptor belt speed and the number of image areas thereon.

Figure 2:
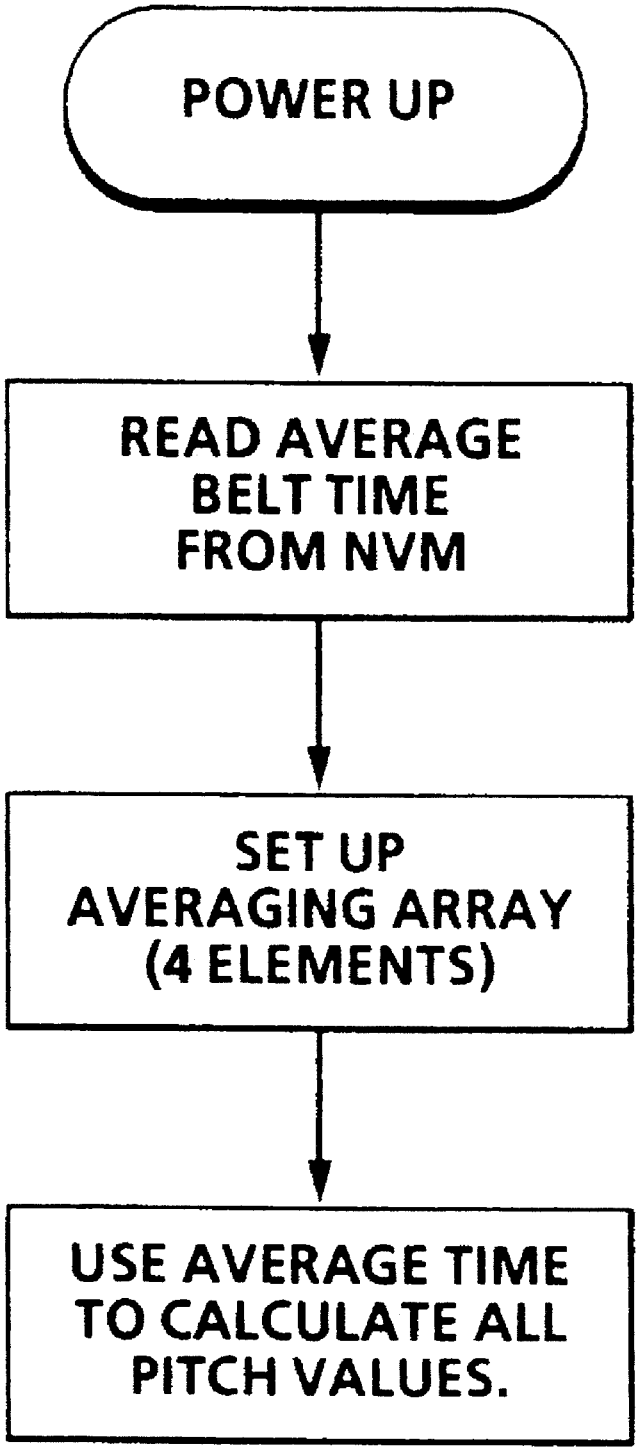

Referring now to FIGS. 1 and 2, the particular features of the automatic variable pitch reconfiguration control of the present invention will be described in greater detail via a pair of flow charts intended to illustrate the steps involved in the control process. Exemplary software code for computer programs utilized in implementing the automatic machine reconfiguration of the present invention is provided in Appendix A, wherein a specific set of instructions are provided for monitoring the photoreceptor belt speed to determine whether the belt speed is beyond a predetermined tolerance value for a given number of pitches and for causing a concommitant and automatic machine reconfiguration for handling the appropriate number of pitches corresponding to the belt speed. It will be understood that the automatic variable pitch reconfiguration control routine provided in Appendix A is disclosed in the form of an exemplary computer program which is embedded into a scheduling routine managed by the controller.

Beginning with the flow chart of FIG. 1, the exemplary control algorithm for reconfiguring the machine in response to the photoreceptor belt speed will be described as a function of a determination of the average photoreceptor belt speed. At the outset, an initial determination of the system mode status must be performed with respect to the system cycle-up or cycle-down mode. It is recognized that the photoreceptor belt speed during system cycle-up may be inaccurate as the belt comes up to speed. Likewise, the belt speed may also be inaccurate during system cycle-down as the belt is coming to a stop. In the case of system cycle-up or cycle-down, the monitored photoreceptor belt speed is ignored and the entire variable pitch reconfiguration control algorithm of the present invention is bypassed.

Assuming that the electrostatographic printing machine is not in the cycle-up or cycle-down mode, the actual photoreceptor belt speed is monitored and a measurement thereof is provided as function of the amount of time required for the photoreceptor belt to travel in one complete revolution. Thus, the photoreceptor belt speed is provided as a function of time, wherein the elapsed time for a full revolution of the photoreceptor belt is provided by detecting the elapsed time between passage of a predetermined point on the belt, as for example, a belt seam or a timing mark. The belt is monitored by a sensor, preferably an optoelectronic device, which detects the presence of a photoreceptor seam or a belt mark during rotation of the photoreceptor belt. The actual belt speed or, more appropriately the actual belt time, is initially compared to a set of predetermined values for determining whether the actual belt time is within a wide predetermined range, such that, if the belt time falls outside of the wide predetermined range so as to be either greater than a predetermined maximum belt time or less than a predetermined minimum belt time, an error signal is generated and logged in a memory module associated with the system scheduling software. This error signal is usually accompanied by a message displayed on a graphic user interface, indicating that the belt time is "out of range".

Assuming that the actual belt time is within the wide predetermined range, the actual belt time is transmitted-to a memory device which stores multiple actual belt times retrieved from the belt timing sensor. The transmission of an actual belt time simultaneously causes a counter to be incremented, initiating an average belt time accumulator routine for summing and averaging a predetermined number of actual belt time measurements to maintain a running average photoreceptor belt time. Each time an actual belt time is transmitted, a new average belt time is computed and recorded in a non-volatile memory (NVM) unit and in a random access memory (RAM) array. Typically, this average belt time accumulator routine calculates the average belt time associated with an updated actual belt time such that the average belt time is determined as a function of a series of most recent actual belt time measurements. Older preceding measurements, which could be characterized as obsolete or outdated actual belt time measurements, are disposed of and are not factored into this average belt time calculation.

After the actual belt time measurements are summed and averaged to provide the average belt time, the current actual belt time and the average belt time are compared and a difference between the current actual belt time and the average belt time is computed. This difference is utilized as a reference value for determining whether the present actual belt time is within a predetermined range relative to the average belt time, indicating that it is necessary to adjust the pitch timing signals, which, in turn, would necessitate a variable pitch machine reconfiguration in order to re-synchronize the various machine subsystems with the current average belt time. In the present example, as illustrated in the flow chart of FIG. 1, if the difference between the actual belt speed and the average belt speed is greater than 100 milliseconds, the actual belt time is considered out of specification such that a system fault is initiated, wherein the machine is cycled down such that the belt speed is brought to an idle state and a "system timing out of range" signal is transmitted to the control panel. The event is also recorded in memory as a logged event for archival purposes.

Upon system fault initiation, the appropriate pitch timing values is calculated as a function of belt speed. In addition, a system reconfiguration or configuration exchange is initiated, whereby the timing and synchronization information corresponding to the new pitch timing values is generated. Thus, the declared fault causes the controller to recalculate the timing of various command signals for synchronizing activation of various machine subsystems in accordance with the appropriate number of pitches. Thereafter, when the fault is cleared (typically when the operator reactuates the machine), the xerographic printing machine will be ready to run with better quality and efficiency since all machine subsystems are now precisely synchronized to the belt speed. The new pitch timing commands are communicated to the appropriate machine subsystems via the machine controller upon reactuation of the machine.

The calculation of the new pitch timing values is illustrated in the flow chart of FIG. 2. At the time of cycle down (as caused by a fault detection), the current average belt time stored in non-volatile memory is read and transmitted into a random access memory array in order to set up an averaging array comprising four elements. This most recent average is used to calculate all the pitch timing values which are thereafter transmitted to the controller to determine scheduling and timing information.

One particular advantage of the present invention may be found in the following illustrative example, wherein the operation baseline software for an exemplary 135 page per minute machine is loaded into a machine designed to run at a much higher speed, for example 180 pages per minute. In this illustrative example, utilizing the control system of the present invention, the electrostatographic printing machine would immediately declare a software fault, indicating that the system timing is out of range. Upon clearing the fault, a new set of pitch timing values would be calculated and transmitted to provide the appropriate pitch timing values for a 180 pitch per minute machine such that the 135 page per minute system software can be utilized to operate an electrostatographic printing machine running at 180 pages per minute. Of course, it will be recognized that the implementation of the present invention is not limited to the above example of 135 pages per minute and 180 pages per minute, whereby the actual speed is limited by motor speeds, central processing unit capabilities, paper paths, etc. Thus, the present invention allows scalability and system reconfiguration using the same software control package so that, at least in theory, a single software control package can be utilized in numerous and various machines. Another advantage and effect of the present invention is to allow an electrostatographic machine to continue to run even if the belt speed drifts out of a specified range. Although throughput will obviously be affected, the system is resynchronized to the actual belt speed so as to maintain system integrity and quality. Thus, the present invention allows the electrostatographic machine scheduling software to run under a large range of machine speeds without being changed.

In review, the automatic photoreceptor belt speed control of the present invention enables the adjustment and recalculation of pitch timing values in response to actual photoreceptor belt speeds. The control algorithm provided herein allows for compensation for irregularities in the speed of the photoreceptor belt and allows for a machine reconfiguration so that the same system software can be used to run various electrostatographic printing machines at different machine speeds.

It is, therefore, evident that there has been provided, in accordance with the present invention, an electrostatographic copying apparatus that fully satisfies the aims and advantages of the present invention as hereinbefore set forth. While this invention has been described in conjunction with a preferred embodiment and method therefor, it is evident that many alternatives, modifications, and variations will be apparent to those skilled in the art. Accordingly, it is intended to embrace all such alternatives, modifications and variations as fall within the spirit and broad scope of the appended claims.

We claim:

1. A method for automatically initiating a machine reconfiguration in an electrostatographic printing machine having a photoreceptor belt, to synchronize activation of various machine subsystems in response to a variation in actual photoreceptor belt speed, comprising the steps of:

measuring actual photoreceptor belt speed for a selected revolution of the photoreceptor belt;

calculating an average photoreceptor belt speed for a plurality of the selected revolutions of the photoreceptor belt;

comparing the actual photoreceptor belt speed to the average photoreceptor belt speed, for determining whether the actual photoreceptor belt speed is within a predetermined range relative to the average photoreceptor belt speed; and initiating a machine reconfiguration in response to a determination that the actual photoreceptor belt speed is outside the predetermined range relative to the average photoreceptor belt speed, wherein said machine reconfiguration step includes:

synchronizing activation of various machine subsystems in accordance with said average photoreceptor belt speed.

2. The method of claim 1, wherein said machine reconfiguration step further includes calculating an appropriate number of pitches to be laid down on the photoreceptor belt as a function of the average photoreceptor belt speed.

3. The method of claim 1, wherein said machine reconfiguration step further includes initiating a machine cycle down in response to a determination that the actual photoreceptor belt speed is beyond the predetermined range relative to the average photoreceptor belt speed.

4. The method of claim 1, further comprising the step of determining whether the electrostatic printing machine is in either a cycle-up or cycle-down mode prior to initiating the actual photoreceptor belt speed measuring step.

5. The method of claim 1, further comprising the step of determining whether the actual photoreceptor belt speed is within a predetermined range prior to initiating the average photoreceptor belt speed calculating step.

6. The method of claim 1, wherein the predetermined range is approximately 100 milliseconds.

7. In an electrostatographic printing apparatus having a photoreceptor belt, a system for automatically initiating a machine reconfiguration to synchronize activation of various machine subsystems in response to a variation in actual photoreceptor belt speed, comprising:

means for measuring actual photoreceptor belt speed for a selected revolution of the photoreceptor belt;

means for calculating an average photoreceptor belt speed for a plurality of selected revolutions of the photoreceptor belt;

means for comparing the actual photoreceptor belt speed to the average photoreceptor belt speed, for determining whether the actual photoreceptor belt speed is within a predetermined range relative to the average photoreceptor belt speed;

means for initiating a machine reconfiguration in response to a determination that the actual photoreceptor belt speed is outside the predetermined range relative to the average photoreceptor belt speed, wherein said machine reconfiguration step includes:

means for synchronizing activation of various machine subsystems in accordance with said average photoreceptor belt speed.

8. The electrostatographic printing apparatus of claim 7, further including means for calculating an appropriate number of pitches to be laid down on the photoreceptor belt as a function of the average photoreceptor belt speed.

9. The electrostatographic printing apparatus of claim 7, further including means for initiating a machine cycle down in response to a determination that the actual photoreceptor belt speed is outside the predetermined range relative to the average photoreceptor belt speed.

10. The electrostatographic printing apparatus of claim 7, further including means for determining whether the electrostatic printing machine is in either a cycle-up or cycle-down mode prior to activating the means for calculating the average photoreceptor belt speed.

11. The electrostatographic printing apparatus of claim 7, further including means for determining whether the actual photoreceptor belt speed is within a predetermined range prior to activating the means for calculating the average photoreceptor belt speed.

12. The electrostatographic printing apparatus of claim 7, wherein the predetermined range is approximately 100 milliseconds.

* * * * *